United States Patent [19]

Horan et al.

[11] Patent Number: 4,811,568

[45] Date of Patent: Mar. 14, 1989

[54] REFRIGERATION SUB-COOLER

[75] Inventors: Thomas R. Horan; Kyle E. Hart, both of Scottsdale, Ariz.

[73] Assignee: RAM Dynamics, Inc., Phoenix, Ariz.

[21] Appl. No.: 210,244

[22] Filed: Jun. 24, 1988

[51] Int. Cl.[4] ..... F25B 41/00

[52] U.S. Cl. ..... 62/200; 62/513; 165/160

[58] Field of Search ..... 62/113, 513, 200; 165/160

[56] References Cited

U.S. PATENT DOCUMENTS

| | | | |
|---|---|---|---|
| 2,051,971 | 8/1936 | Swart | 62/8 |
| 2,388,556 | 11/1945 | Lathrop | 62/115 |
| 2,797,554 | 7/1957 | Donovan | 62/117.55 |
| 2,819,592 | 1/1958 | Smith | 62/117.55 |
| 2,990,698 | 7/1961 | Crotser | 62/503 |
| 3,258,933 | 7/1966 | Osborne | 62/98 |
| 3,264,837 | 8/1966 | Harnish | 62/117 |
| 3,316,961 | 5/1967 | Dorner | 165/145 |
| 3,423,954 | 1/1969 | Harnish et al. | 62/222 |
| 3,446,032 | 5/1969 | Bottum | 62/513 |
| 3,481,151 | 12/1969 | Seeley | 62/196 |
| 3,553,974 | 1/1971 | Osborne | 62/115 |
| 3,596,474 | 8/1971 | Bloxham | 62/93 |
| 3,765,192 | 10/1973 | Root | 62/324 |
| 4,142,381 | 3/1979 | Lavigne, Jr. | 62/510 |
| 4,207,749 | 6/1980 | Lavigne, Jr. | 62/115 |
| 4,232,533 | 11/1980 | Lundblad et al. | 62/509 |
| 4,316,366 | 2/1982 | Manning | 62/200 |
| 4,357,805 | 11/1982 | Manning | 62/117 |
| 4,440,217 | 4/1984 | Stieler | 165/155 |
| 4,476,695 | 10/1984 | Epps | 62/512 |
| 4,577,468 | 3/1986 | Nunn, Jr. et al. | 62/113 |
| 4,683,726 | 8/1987 | Barron | 62/503 |
| 4,694,662 | 9/1987 | Adams | 62/509 |
| 4,696,168 | 9/1987 | Woods et al. | 62/200 |

*Primary Examiner*—William E. Tapoical
*Attorney, Agent, or Firm*—LaValle D. Ptak

[57] ABSTRACT

A sub-cooler for a refrigeration system is located between the condenser and the expansion device for the evaporator. The sub-cooler has a sealed cylindrical housing with a main inlet coupled to the outlet of the condenser. This inlet is connected to a spray bar located along the length of the housing near its top, and spray apertures are distributed along the length of the spray bar to spray the refrigerant into the interior of the sub-cooler housing. The temperature controlled expansion valve supplies a tapped off portion of the refrigerant from the condenser to a distributor located within the housing. Three to six separate cooling coils, having multiple turns, extend from the distributor throughout the interior of the housing. The other ends of the cooling coils are coupled with a collector in the housing, and the outlet from the collector is injected into the main suction line coupled to the inlet of the compressor. An outlet is connected to the bottom of the sub-cooler housing for supplying refrigerant to the expansion valve for the evaporator. Refrigerant is sub-cooled a few degrees within the sub-cooler; and, in addition, gas bubbles are removed from the refrigerant supplied to the primary expansion device for the system.

26 Claims, 1 Drawing Sheet

REFRIGERATION SUB-COOLER

BACKGROUND

Vapor compression types of refrigeration systems are employed in a wide range of applications, such as, cooling building interiors, and in freezer and refrigerator units in a wide range of sizes and different configurations. Typically, such systems employ a compressor to increase the temperature and pressure of a gaseous refrigerant. The output of the compressor then is supplied to a condensor, where the gaseous refrigerant is changed to a liquid refrigerant. Liquid refrigerant from the condensor is supplied through an expansion valve into an evaporator which is used to absorb heat energy from the surrounding air or other medium to be cooled. Gaseous refrigerant leaving the evaporator then is supplied back to the compressor, where the cycle is repeated.

It has been found in such systems that the liquid refrigerant leaving the condensor frequently includes bubbles of gaseous refrigerant in it. This tends to reduce the efficiency of the system. Thus, a greater amount of refrigerant must be used at a higher pressure than otherwise would be the case if a complete conversion from gas to liquid took place in the condensor prior to supplying the refrigerant to the expansion device or expansion valve at the evaporator.

Currently there is much concern also over the effects of escaped refrigerant upon the ozone layer surrounding the earth. Scientific studies indicate that the ozone layer is being destroyed by chemicals of the type used in refrigeration systems throughout the world. As increased amounts of such refrigerants are released into the atmosphere, through leaks or in other ways, serious and possibly permanent damage to the ozone layer is taking place. Consequently, it is desirable, to the extent possible, to minimize the amount of refrigerant required in any given system for accomplishing the desired cooling purpose. The amount of refrigerant used in any given cooling system is referred to as the "charge" of that system.

Obviously, if the amount of refrigerant can be reduced without a corresponding reduction in the cooling capacity of the system, several advantages occur. First of all, there is less refrigerant available to leak into the atmosphere to cause damage to the ozone layer. In addition, the cost of the refrigerant for the system is reduced since less refrigerant is used. Finally, when less refrigerant is required in a given system, the pressure of the refrigerant provided by the compressor does not need to be as high as when a greater amount of refrigerant is present. This results in a reduction of the mechanical strain on the sytem, thereby increasing the useful life of the various components used in the refrigeration system.

Efforts have been made in the past to improve the efficiency of refrigeration systems by inserting a sub-cooler in the system between the output of the condensor and the input to the expansion device for the evaporator. Sub-coolers for accomplishing this purpose are disclosed in the two patents to Lavigne U.S. Pat. Nos. 4,142,381 and 4,207,749. In the systems disclosed in these patents, the refrigerant leaving the condensor is sprayed into the interior of a sealed heat exchanger. The heat exchanger operates as a sub-cooler and has a cooling medium circulated through cooling coils located in it. The cooling medium is provided from an external source, such as a cool water supply or the like. The refrigerant sprayed into the interior of this heat exchanger comes into contact with the cooling coils and is reduced in temperature. The liquid refrigerant collecting at the bottom of the heat exchanger then is supplied to the expansion valve for the evaporator.

The system of these patents however, has a disadvantage because of the necessity to provide a separate coolant for the sub-cooler heat exchangers from a source outside of the refrigeration system itself. Four other patents disclosing systems which do not require an external coolant for a refrigeration sub-cooler, but which use a tapped off portion of the refrigerant to cool the main refrigerant in a sub-cooler unit, are the U.S. Pat. Nos. to Manning 4,316,366 and 4,357,805; Woods 4,696,168 and Nunn 4,577,468. All of these patents disclose systems in which a sub-cooler chamber is utilized between the condensor and the expansion valve for the evaporator. A heat exchange unit is provided through which the main refrigerant passes. A portion of the main refrigerant is tapped off and supplied through an expansion valve to a cooling coil or a cooling jacket to provide sub-cooling to the main refrigerant passing through the unit. The diverted vaporized refrigerant which is used to provide this sub-cooling is supplied back to the suction line from the evaporator to join the vaporized refrigerant from the evaporator prior to resupplying the refrigerant to the compressor for the system.

The systems of these four patents all provide some degree of sub-cooling to the main refrigerant. These systems, however, do not function to eliminate any entrained gas bubbles in the liquid refrigerant, since the refrigerant line essentially is the same as in conventional systems, except that it does pass through the sub-cooler unit. In addition, a single heat exchange chamber or a single cooling coil is employed in these systems, so only a limited amount of sub-cooling can be accomplished in them.

A different approach for a refrigeration sub-cooler is disclosed in the U.S. Pat. Nos. to Osborne 3,553,974; Adams 4,694,662; and Barron 4,683,726. In the systems of these patents, the output of the condensor is supplied through a sub-cooler chamber in which the entire amount of coolant from the condensor is sprayed through a spray bar into the interior of the sub-cooler. This causes a flashing of some of the coolant; and, theoretically, the refrigerant is cooled as a result of the slight pressure reduction and flashing which takes place in the sub-cooler chamber. In addition, the bubbles of gaseous refrigerant theoretically are removed, so that only liquid refrigerant is withdrawn from the sub-cooler at the bottom.

In the system of the Osborne Patent, the gaseous vapor which is present in the sub-cooler chamber is withdrawn from the top and supplied back to the suction line at the input of the compressor. The Barron Patent recognizes a drawback of the overall systems disclosed in Osborne and Adams, and places the sub-cooler in the cold air stream passing out of the evaporator to supplement and enhance the sub-cooling function of the sub-cooler. As disclosed in the Barron Patent, it is necessary to place a sub-cooler of the type disclosed in Osborne and Adams in a cool air stream or another cooling heat exchange environment in order effectively to provide any sub-cooling action.

It is desirable to provide a refrigeration sub-cooler which overcomes the disadvantages of the prior art sub-coolers mentioned above, which is efficient and effective in operation, which does not require a separate cooling medium, and which both sub-cools the liquid refrigerant and removes gaseous bubbles from it during operation.

SUMMARY OF THE INVENTION

It is an object of this invention to provide an improved refrigeration system.

It is another object of this invention to provide an improved sub-cooler for a refrigeration system.

It is an additional object of this invention to provide an improved sub-cooler for a refrigeration system which provides a sub-cooling effect without requiring a supplemental cooling medium in addition to the refrigerant self-contained within the system itself.

It is a further object of this invention to provide an improved sub-cooler for a refrigeration system in which a portion of the main refrigerant is tapped off, expanded, and supplied through a plurality of parallel heat exchange coils within the sub-cooler in heat exchange relationship with the main refrigerant sprayed onto the coils within the sub-cooler, to both sub-cool the refrigerant and remove gas bubbles from the refrigerant prior to supplying such refrigerant to the evaporator of the refrigeration system.

In accordance with a preferred embodiment of this invention, a sub-cooler for a refrigeration system has an outer housing with a main inlet coupled to the condensor outlet of the refrigeration system. A main outlet also is provided which is coupled to the expansion device of the refrigeration system. A spray bar is connected to the main inlet and extends within the housing to spray refrigerant into the interior of the housing through a plurality of apertures. A plurality of separate cooling coils are provided in the housing, and each one of these coils is connected between a second inlet and a second outlet in the housing. These coils are supplied with a tapped off portion of the refrigerant through an expansion valve to cause the temperature of the coils to be lower than that of the refrigerant sprayed onto them from the spray bar. Thus, the main refrigerant is cooled by the tapped off refrigerant passing through the plurality of cooling coils.

DETAILED DESCRIPTION

Figure 1:
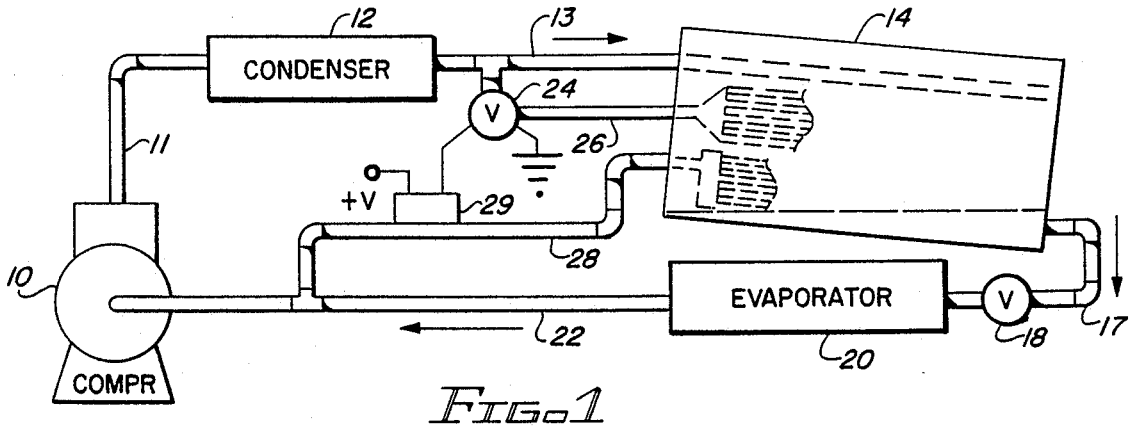
FIG. 1 is a diagramatic view of a preferred embodiment of the invention.

Reference now should be made to the drawing in which the same reference numbers are used throughout the different figures to designate the same components.

Figure 2:
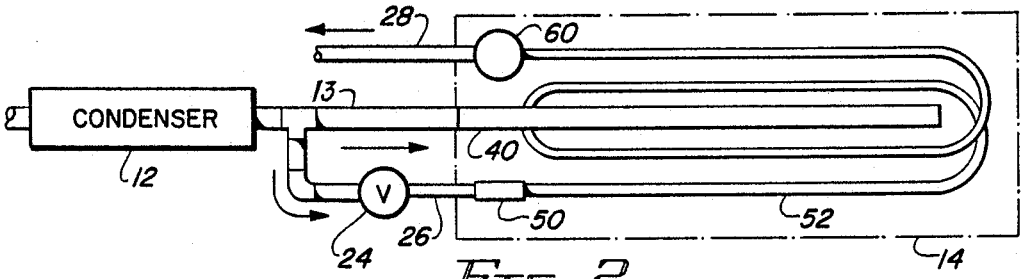
FIG. 2 is a top diagramatic view of a portion of the embodiment shown in FIG. 1.

Referring initially to FIGS. 1 and 2, a refrigeration system of the type typically used for a residence or the like is illustrated diagramatically. This system comprises a compressor 10, which has a discharge line 11 for supplying hot gaseous refrigerant to the inlet of a condensor 12. The condensor 12 operates in a conventional manner to reduce the temperature of the refrigerant and to discharge the refrigerant in a liquid form through a line 13. Refrigerant in the line 13 is supplied to the inlet of a sub-cooler 14, and sub-cooled refrigerant exits from the sub-cooler 14 through a line 17 to an expansion valve 18. Refrigerant within the sub-cooler 14 is cooled, and gaseous bubbles of refrigerant are removed from it prior to supplying the cooled refrigerant to the expansion valve 18. The expansion valve 18 operates in a conventional manner to flash the liquid refrigerant prior to supplying it to an evaporator 20, which constitutes the heat exchange unit for cooling the residence or other device with which the system is used. After the refrigerant has accomplished the heat exchange relationship desired, it is supplied through a suction line 22 back to the inlet of the compressor 10. To the extent described above, the system is of the general type of conventional refrigeration systems which employ a sub-cooler for improving the efficiency and operating characteristics of a refrigeration system.

Figure 3:
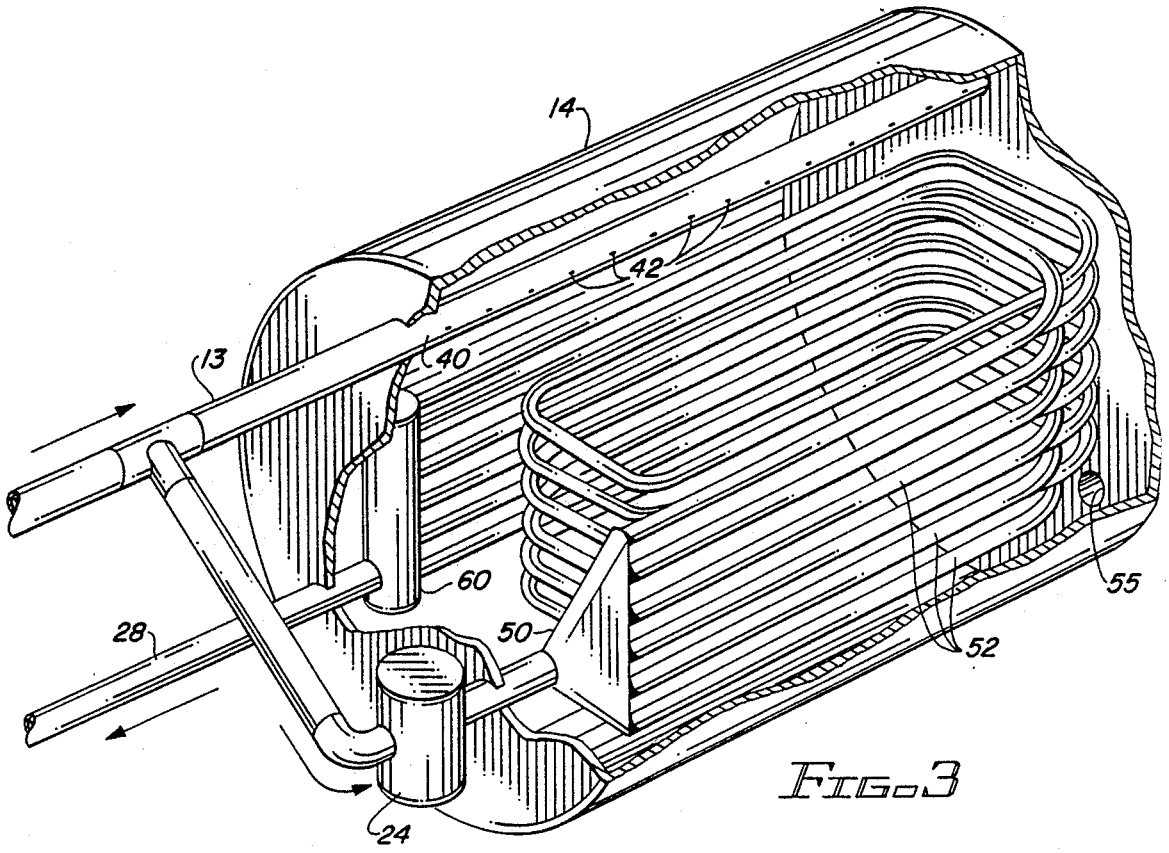
FIG. 3 is a partially cutaway, perspective view of a preferred embodiment of the invention.

As illustrated in greater detail in FIGS. 2 and 3, the sub-cooler 14 of a preferred embodiment of the invention is supplied with a tapped off portion of the main refrigerant supplied from the condensor 12 through a thermal expansion valve 24. From the valve 24, expanded refrigerant passes through a supply line 26 to a distributor 50 which supplies the expanded refrigerant to one end of each of six multiple turn cooling coils 52 located within the outer housing 14 of the sub-cooler. The other ends of the coils 52 are connected in parallel to a collector 60, the output of which is supplied to a line 28 coupled to the main suction line 22. Thus, the vaporized refrigerant from the sub-cooler 14 is supplied back to the compressor 10 along with the main portion of vaporized refrigerant supplied from the evaporator 20 through the line 22.

The heat exchange relationship which takes place within the sub-cooler 14 is provided by supplying the main portion of the refrigerant through the line 13 into a spray bar 40 which extends along the length of the outer housing 14 of the sub-cooler and is located near the top of that outer housing. A plurality of spray nozzles 42 are located at spaced intervals along the length of the spray bar 40. These nozzles are located to spray the refrigerant in a fan-like pattern outwardly and downwardly into physical contact with the separate parallel cooling coils 52 located throughout the interior of the housing 14. As the refrigerant passing out of the nozzles 42 comes into contact with the various cooling coils 52, the temperature is dropped; and liquid refrigerant pools or locates at the bottom of the housing 14, as indicated in dotted lines in FIG. 1. An outlet 55 is provided near the bottom of the right-hand end of the housing 14 (as viewed in all three figures), and this outlet is connected to the line 17 to supply the liquid refrigerant to the main expansion valve 18 for the system.

Since the expanded coolant supplied from the thermal expansion valve 24 is provided in parallel through the distributor to each of the six cooling coils 52, all of the cooling coils 52 have substantially the same temperature of coolant supplied through them, so that the cooling action taking place within the housing 14 is uniform throughout the housing. The orientation of the various cooling coils 52 within the housing may be effected in a different relationship to the spray bar 40 from the one illustrated, but the orientation illustrated has been found to be very effective in a commercial embodiment of the invention which has been successfully operated.

Effective cooling throughout the interior of the housing 14 of the sub-cooler is effected by the multiple turn separate cooling coils 52. As illustrated, each of the cooling coils 52 has two complete turns within the housing 14. The number of turns of each of the cooling coils 52 and, in addition, the number of cooling coils themselves may be varied. Although six cooling coils are shown in FIG. 3, a typical number of cooling coils ranges from three to six or more, depending upon the size of the refrigeration system and the size of the sub-cooler 14.

As mentioned previously, the expansion valve 24 is a thermal expansion valve. It is operated either directly by temperature variations sensed by a temperature sensing unit 29 mounted in a thermal heat transfer relationship with the suction line 22, or it is electrically operated by signals from such a thermal sensor 29 to vary the operation of the expansion valve to control the amount of diverted refrigerant which is supplied to the distributor 50 located within the sub-cooler housing 14. The rate of flow through the valve 24 is varied in accordance with temperature variations from the output of the evaporator 20 to optimize the operation of the sub-cooler 14.

Typically, a system of the type which is illustrated in FIGS. 1 through 3, operates with conventional refrigerants, such as R-22, and in a typical installation, the evaporator temperature of the evaporator 20 is set up for a 40° F. temperature of the evaporator coils. The temperature sensed at the output of the sub-cooler 14 on the suction line 28 by the sensor 29 for such a system typically is in the range of 50° F. The valve 24 is controlled to provide sufficient refrigerant to the coils 52 to produce approximately a 6° F. drop in temperature between the liquid refrigerant entering the spray bar 40 and the refrigerant leaving the bottom of the evaporator 14 through the aperture 55.

A relatively small amount of refrigerant (approximately 5%) is tapped off from the main line 13 through the expansion valve 24 to produce the sub-cooling effect. In addition, it should be noted that in an optimum operating system, the total area of the spray apertures 42 is selected to be equal to the cross-sectional area of the internal diameter of the pipe 13 and spray bar 40. This produces a minimum pressure change within the housing 14 of the evaporator.

The system also operates to maintain the liquid/gas ratio essentially constant, so there is no critical charge of refrigerant in the system. Because the sub-cooler 14 is employed between the condensor and the expansion device or expansion valve 18, liquid refrigerant constantly is supplied through the line 14 to the expansion valve 18. Since a critical charge is not necessary, a reduction in the amount of charge, compared to a conventional system of the same capacity, may be made. This reduction typically is of the order of 10% to 30%. As a result, when the sub-cooler 14 is installed in a conventional system, the amount of refrigerant used to charge a system may be reduced and the compressor 10 supplies refrigerant at a lower pressure then is otherwise necessary for the same cooling capacity. Consequently, the compressor 10 is far less subject to overloading and overheating than with a conventional system not employing a sub-cooler 14 of the type which has been described above.

Various changes and modifications will occur to those skilled in the art without departing from the true scope of the invention. For example, as mentioned previously, the number of cooling coils located within the sub-cooler may be varied and the particular configuration and orientation of these cooling coils relative to the apertures in the spray bar also may be varied without departing from the scope of the invention. A typical size of the sub-cooler housing 14 is a cylinder having an internal diameter of three and $\frac{7}{8}$ inches and a length of sixteen inches. Clearly, these dimensions are illustrative only of a typical installation and they may be varied for installations which have different operating requirements.

We claim:

1. In a refrigeration system comprising a compressor, a condensor, a sub-cooler, an expansion device, and an evaporator, connected in series in the order named, with the outlet of the compressor connected to the inlet of the condensor, the outlet of which supplies liquid refrigerant to the sub-cooler from which liquid refrigerant is supplied to the expansion device and the evaporator, and with the outlet of the evaporator connected to the inlet of the compressor; an improvement in the sub-cooler including in combination:

an outer housing, having a main inlet coupled to the condensor outlet and a main outlet coupled to the expansion device, and having a second inlet and a second outlet;

a spray bar, having first and second ends of a predetermined length, located within said housing and coupled at said first end to said main inlet to receive refrigerant therefrom, said spray bar having a plurality of apertures therein for spraying refrigerant therefrom into the interior of said housing;

a plurality of separate cooling coils in said housing, each cooling coil having an inlet end and an outlet end;

distributor means located within said housing;

collector means located within said housing;

said distributor means having an inlet and a plurality of outlets corresponding to said plurality of cooling coils, the inlet of said distributor means coupled with said second inlet and the outlets thereof coupled with the corresponding inlets of said plurality of cooling coils;

said collector means having a plurality of inlets and an outlet, the plurality of inlets thereof coupled with the outlet ends of said plurality of separate cooling coils and the outlet thereof coupled with said second outlet;

expansion valve means coupled with the outlet of the condensor to receive refrigerant therefrom and coupled with said second inlet of said housing for supplying expanded refrigerant thereto; and means coupling said second outlet of said outer housing with the inlet of the compressor.

2. The combination according to claim 1 wherein said spray bar is closed at said second end thereof and said apertures therein each have an area substantially less than the internal cross-sectional area of said spray bar.

3. The combination according to claim 2 wherein the total cross-sectional area of said plurality of apertures is substantially equal to the internal cross-sectional area of said spray bar.

4. The combination according to claim 3 wherein said spray bar is a tubular spray bar.

5. The combination according to claim 4 wherein said expansion valve means passes a relatively small fraction of the total refrigerant available from the outlet of the condensor to said second inlet of said outer housing.

6. The combination according to claim 5 wherein each of said plurality of cooling coils extends within the interior of said outer housing in a position to contact refrigerant sprayed from said apertures in said spray bar.

7. The combination according to claim 6 wherein each of said cooling coils includes multiple loops extending substantially throughout the length of said housing in a region to be contacted from refrigerant sprayed from said apertures in said spray bar.

8. The combination according to claim 7 wherein said spray bar is located near the top of said outer housing and said cooling coils extend throughout the area beneath said spray bar to be contacted by refrigerant passing out of said apertures.

9. The combination according to claim 8 wherein said second inlet and said second outlet of said outer housing are located in the same end thereof with said distributor and said collector located adjacent such end, and further wherein each of said cooling coils extends from said distributor substantially along the length of said spray bar and returns to said collector within said housing.

10. The combination according to claim 9 wherein said expansion valve means is a variable valve means for supplying varying amounts of refrigerant therethrough.

11. The combination according to claim 10 wherein said expansion valve means is a temperature valve means; and further including temperature sensing means coupled with the second outlet for sensing the temperature of refrigerant therefrom; and means interconnecting said temperature sensing means with said expansion valve means for controlling the operation thereof in accordance with the temperature sensed by said temperature sensing means.

12. The combination according to claim 11 wherein said plurality of cooling coils comprises three to six cooling coils.

13. The combination according to claim 12 wherein said outer housing is a cylindrical housing closed at both ends thereof and physically oriented with said main inlet located near the top thereof and said main outlet located at the opposite end thereof near the bottom thereof.

14. The combination according to claim 1 wherein said plurality of cooling coils comprises three to six cooling coils.

15. The combination according to claim 14 wherein each of said plurality of cooling coils extends within the interior of said outer housing in a position to contact refrigerant sprayed from said apertures in said spray bar.

16. The combination according to claim 15 wherein each of said cooling coils includes multiple loops extending substantially throughout the length of said housing in a region to be contacted from refrigerant sprayed from said apertures in said spray bar.

17. The combination according to claim 16 wherein said spray bar is located near the top of said outer housing and said cooling coils extend throughout the area beneath said spray bar to be contacted by refrigerant passing out of said apertures.

18. The combination according to claim 1 wherein said expansion valve means passes a relatively small fraction of the total refrigerant available from the outlet of the condensor to said second inlet of said outer housing.

19. The combination according to claim 18 wherein said expansion valve means is a variable valve means for supplying varying amounts of refrigerant therethrough.

20. Thye combination according to claim 19 wherein said expansion valve means is a temperature controlled valve means; and further including temperature sensing means coupled with the second outlet for sensing the temperature of refrigerant therefrom; and means interconnecting said temperature sensing means with said expansion valve means for controlling the operation thereof in accordance with the temperature sensed by said temperature sensing means.

21. The combination according to claim 1 wherein the total cross-sectional area of said plurality of apertures is substantially equal to the internal cross-sectional area of said spray bar.

22. The combination according to claim 21 wherein said outer housing is a cylindrical housing closed at both ends thereof and physically oriented with said main inlet located near the top thereof and said main outlet located at the opposite end thereof near the bottom thereof.

23. The combination according to claim 22 wherein said spray bar is a tubular spray bar.

24. The combination according to claim 1 wherein said outer housing is a cylindrical housing closed at both ends thereof and physically oriented with said main inlet located near the top thereof and said main outlet located at the opposite end thereof near the bottom thereof.

25. The combination according to claim 24 wherein said spray bar is located near the top of said outer housing and said cooling coils extend throughout the area beneath said spray bar to be contacted by refrigerant passing out of said apertures.

26. The combination according to claim 1 wherein each of said plurality of cooling coils extends within the interior of said outer housing in a position to contact refrigerant sprayed from said apertures in said spray bar.

* * * * *